US005363735A

United States Patent [19]

Kondo

[11] Patent Number: 5,363,735

[45] Date of Patent: Nov. 15, 1994

[54] ELECTRONIC MUSICAL INSTRUMENT OF VARIABLE TIMBRE WITH SWITCHABLE AUTOMATIC ACCOMPANIMENT

[75] Inventor: Masao Kondo, Hamamatsu, Japan

[73] Assignee: Yamaha Corporation, Hamamatsu, Japan

[21] Appl. No.: 979,637

[22] Filed: Nov. 19, 1992

[30] Foreign Application Priority Data

Nov. 20, 1991 [JP] Japan ..... 3-305141

[51] Int. Cl.[5] ..... G10H 1/06; G10H 1/36; G10H 1/42

[52] U.S. Cl. ..... 84/622; 84/634; 84/635; 84/DIG. 12

[58] Field of Search ..... 84/609–614, 84/622–625, 634–638, DIG. 12, DIG. 22

[56] References Cited

U.S. PATENT DOCUMENTS 4,699,039 10/1987 Oguri et al. ..... 84/622
4,829,869 5/1989 Katada et al. ..... 84/622
4,936,183 6/1990 Rauchi et al. ..... 84/610
5,179,240 1/1993 Mizuno et al. ..... 84/613

*Primary Examiner*—Stanley J. Witkowski
*Attorney, Agent, or Firm*—Spensley Horn Jubas & Lubitz

[57] ABSTRACT

An electronic musical instrument has a keyboard and a sound source circuit for manual performance along with automatic accompaniment. A memory is provided for memorizing a plurality of rhythm patterns of the automatic accompaniment such as introduction, normal, fill-in and ending. The memory further stores timbre codes corresponding to the respective rhythm patterns, effective to specify tone color of the manual performance. Selecting switches are manually operated during the manual performance for selecting a desired rhythm pattern. A CPU accesses the memory to retrieve the selected rhythm pattern so as to switch the automatic accompaniment to the selected rhythm pattern. The CPU concurrently controls the sound source circuit to change the tone color of the manual performance according to a particular timbre code associated to the selected rhythm pattern.

16 Claims, 13 Drawing Sheets

ELECTRONIC MUSICAL INSTRUMENT OF VARIABLE TIMBRE WITH SWITCHABLE AUTOMATIC ACCOMPANIMENT

BACKGROUND OF THE INVENTION

The present invention relates to an electronic musical instrument having an automatic accompaniment mode.

A certain conventional electronic musical instrument of the automatic accompaniment type may have a particular function called "variation" such that a player can set and select a desired rhythm pattern every one or more measures or part of each measure during the course of continuous manual performance of a given music composition having a specific rhythm style. One rhythm style such as rock'n'roll or waltz may contain typically six variation rhythm patterns, i.e., normal pattern, bridge pattern, introduction pattern, ending pattern and two fill-in patterns (one of which shifts to normal pattern and another of which shifts to bridge pattern after fill-in pattern). During the course of manual performance with the aid of automatic accompaniment of a rhythm part with or without an auto-bass-chord (hereinafter, ABC) part containing bass and chord tones, the above noted variation rhythm patterns are suitably switched to change music mood, thereby realizing rich and full performance while modulating the music composition.

The normal pattern represents a basic pattern of a given rhythm style. The bridge pattern has a somewhat different impression than the normal pattern, and is effective when used in a climax period of the music composition. The introduction pattern is adopted to a given music style to enable a natural performance start of the music composition. The ending pattern is adopted to a given music style to enable a natural performance ending to terminate the rhythm accompaniment. The fill-in pattern is a somewhat irregular pattern different than those of the normal pattern and the bridge pattern, and is selected temporarily to impart a rhythm variation to the music composition. In some applications of the above mentioned "variation" method, the chord and bass patterns may be separately varied while the rhythm pattern is unchanged.

In the conventional electronic musical instrument, a timbre of musical sounds may be also switched during the course of manual performance such that, for example, piano sound can be switched to guitar sound or organ sound. Such timbre change is effected conventionally by either of the following two methods. A first method utilizes a plurality of timbre selecting switches provided correspondingly to a plurality of timbres representative of piano, guitar, organ and so on. These timbre selecting switches are manually operated to select instantly a desired timbre. A second method utilizes a registration function such that the electronic musical instrument is provided with a memory for provisionally registering a setting state of various buttons, levers and volume wheels on an operating panel as one group (which is called "registration"). The setting state of timbre etc. is provisionally stored in the memory as a part of each "registration". A particular registration is selected by operating a corresponding registration switch to effect the change in timbre etc.

In the conventional electronic musical instrument, it is desired to change the timbre concurrently with switching of the rhythm patterns during the course of manual performance along with automatic rhythm accompaniment with or without ABC, in order to further modify the music composition to effectively improve the quality of the performance. However, in practical terms, it is difficult to change the timbre simultaneously with a transition timing of the different rhythm patterns during the course of manual performance along with the automatic rhythm accompaniment. For example, with regard to the above mentioned first prior art, precedingly a rhythm selecting switch is operated during the manual performance, and then succeedingly a timbre selecting switch must be actuated while timing a transition moment from one variation rhythm pattern to another variation rhythm pattern. However, double manipulation of the two separate selecting switches is practically complicated in the middle of manual performance. Moreover, it is quite difficult to timely actuate the timbre selecting switch at the transition moment of variation rhythm patterns. Namely, the transition occurrence of variation rhythm patterns is not always fixed. For example, in the case of the ending pattern, when an ending switch is actuated to select the ending pattern within a first half period of one measure, a current rhythm pattern is instantly switched to the selected ending pattern. On the other hand, where the ending switch is actuated within a second half period of one measure, the ending pattern is initiated from a top of a next measure. Moreover, if all fingers of both hands are working on a keyboard incidentally at a just timing, a selecting switch cannot be timely addressed, thereby missing the just timing.

With regard to the above-mentioned second prior art, it may be possible to select either of a non-temporary variation rhythm pattern and a timbre by operation of one registration switch. However, normally temporary variation rhythm patterns such as the fill-in pattern and ending pattern etc. are not involved in "registration", and therefore they cannot be registered. Thus, it is impossible to effect concurrent switching of the timbre with these fill-in and ending patterns.

SUMMARY OF THE INVENTION

In view of the above noted drawback of the prior art, an object of the invention is to provide an improved electronic musical instrument well controllable to effect simultaneous switching of the variation rhythm pattern and the timbre. According to the invention, the electronic musical instrument is comprised of memory means for storing a plurality of rhythm patterns for use in automatic accompaniment and for storing a plurality of timbre codes correspondingly to respective ones of the rhythm patterns for use in determining a tone color of manual performance, selecting means for selecting a desired rhythm pattern, and control means for retrieving the selected rhythm pattern from the memory means to effect the automatic accompaniment and concurrently controlling the tone color of the manual performance based on the timbre code corresponding to the selected rhythm pattern. In such a construction, the control means retrieves from the memory means a desired rhythm pattern designated by the selecting means, and concurrently modifies the tone color of the manual performance according to the specific timbre code correspondingly associated to the selected rhythm pattern.

DETAILED DESCRIPTION OF THE INVENTION

Figure 1:
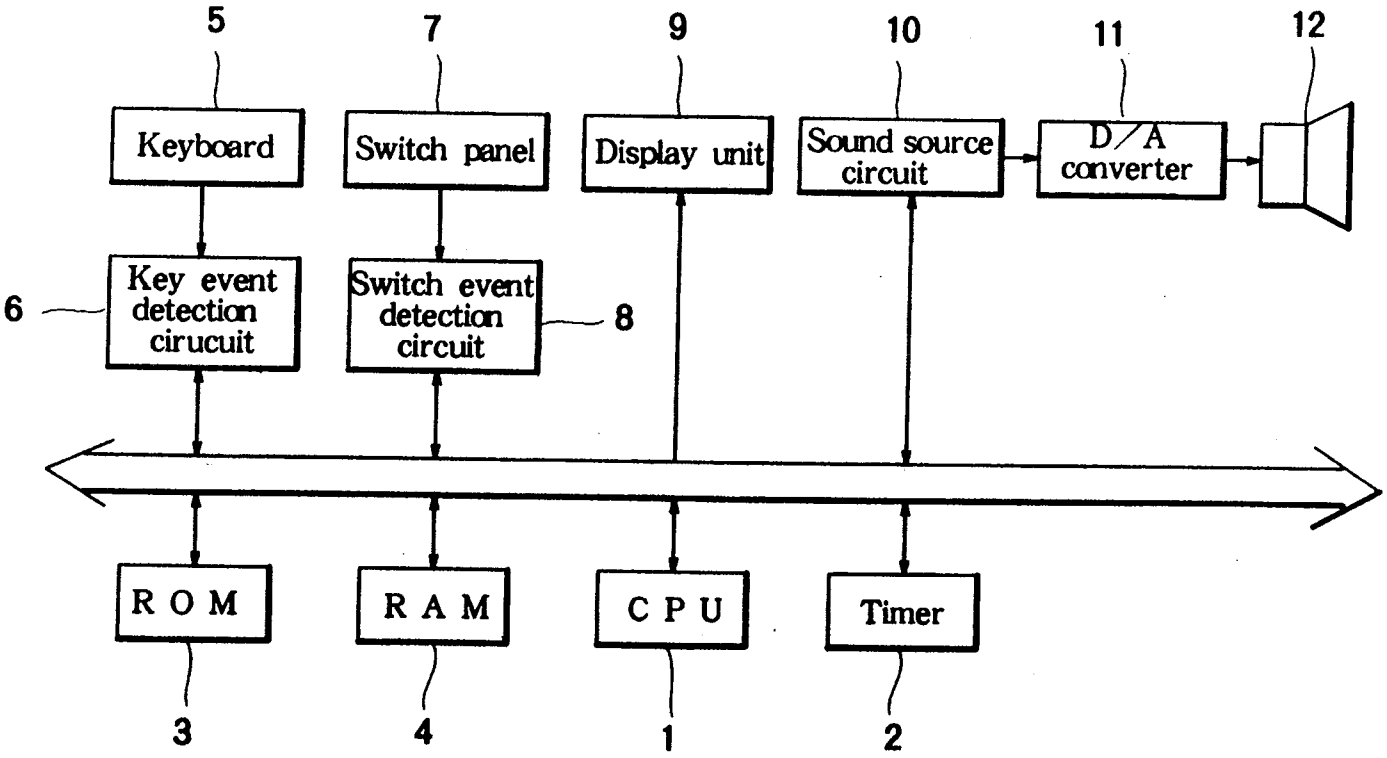
FIG. 1 is a block diagram showing an overall construction of the inventive electronic musical instrument.

Hereinafter, one embodiment of the invention will be described in conjunction with the drawings. FIG. 1 is a block diagram showing an overall construction of the inventive electronic musical instrument. As shown, the instrument comprises a central processing unit (CPU) 1 for controlling various units of the instrument, a timer 2 set with interval data by the CPU 1 for feeding a timer interruption pulse to the CPU 1 whenever a given period determined by the interval data lapses. Further, there are provided a ROM 3 for storing a control program used in CPU 1, and a RAM 4 which contains various registers, flags and key event buffers, those of which are utilized when CPU 1 executes various processes, and which contains an automatic accompaniment data area which stores prescribed sequential data for automatic accompaniment.

Figure 2:
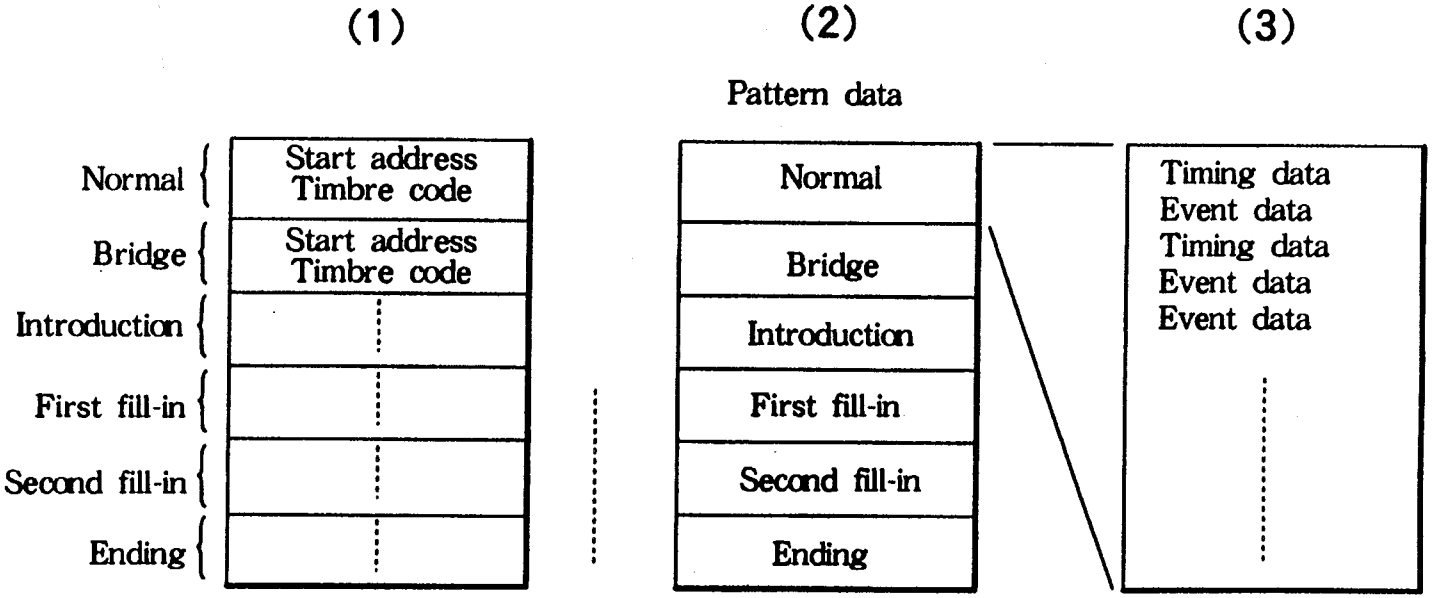
FIG. 2 is a schematic diagram showing an arrangement of an automatic accompaniment data area in the inventive electronic musical instrument.

FIG. 2 shows an exemplary arrangement of the automatic accompaniment data area. The automatic accompaniment data area is composed of part (1) and part (2). The part (1) contains several address data areas, each of which stores a start address of each variation rhythm pattern, i.e., normal, bridge, introduction, first fill-in, second fill-in and ending, as well as a timbre code which is preset by a player for determining a tone color of manual performance. The part (2) contains several pattern data areas, each of which stores a pattern data of one measure length written from a start address which is stored in the corresponding address data area for each variation rhythm pattern. A part (3) of FIG. 2 shows an exemplified pattern data format written in the first pattern data area of part (2) which is assigned to the normal pattern. The pattern data format is comprised of a sequence of timing data and event data. One set of the timing data and the event data represents one note. The timing data indicates a time interval in terms of clock number, from a top of one measure to an occurrence of the event data which follows the timing data. The event data contains a given note number corresponding to a designated rhythm instrument and a velocity data indicative of a tone volume. In the automatic accompaniment, the event may simply represent sounding of a rhythm tone, or otherwise may represent sounding of a chord tone for ABC. The remaining data locations have a similar data format for different rhythm patterns.

Referring back to FIG. 1, the instrument further includes a keyboard 5 containing plural keys, and a key event detection circuit 6 for detecting operation of the keys on the keyboard 5 to produce key information corresponding to the operated keys. A switch panel 7 is also provided.

Figure 3:
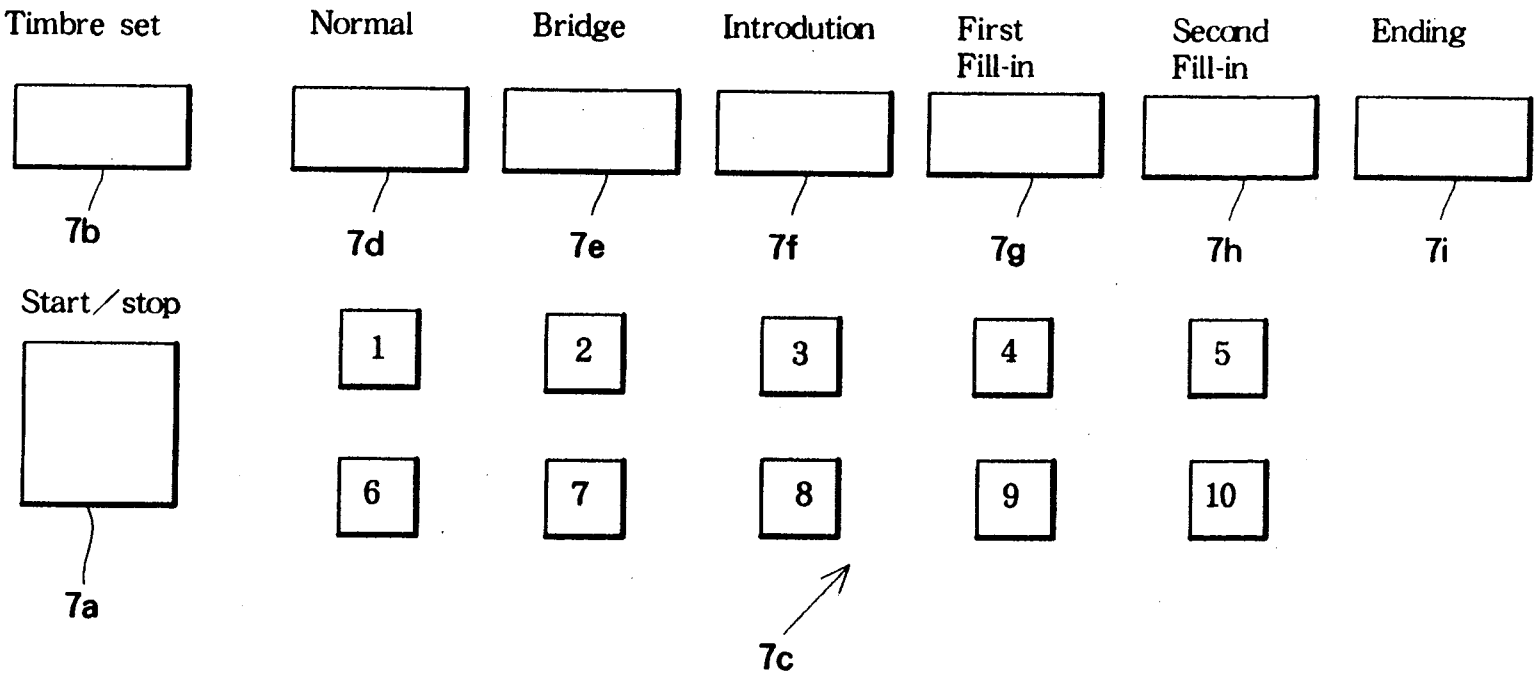
FIG. 3 is a schematic plan view showing an arrangement of a switch panel provided in the inventive electronic musical instrument.
Figure 4:
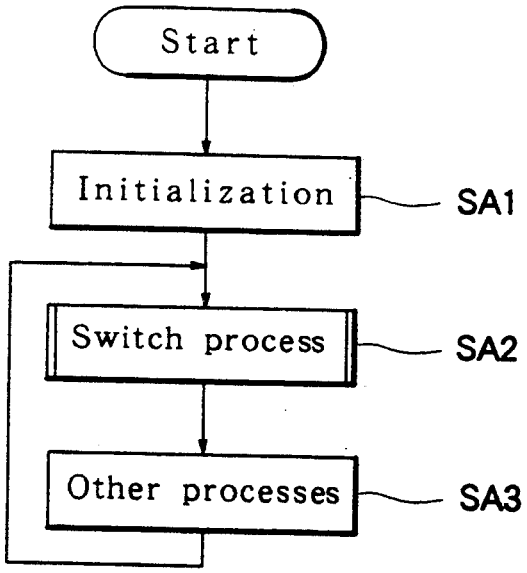
FIGS. 4–14 are flowcharts showing various operational aspects of a CPU provided in the inventive electronic musical instrument.
Figure 5:
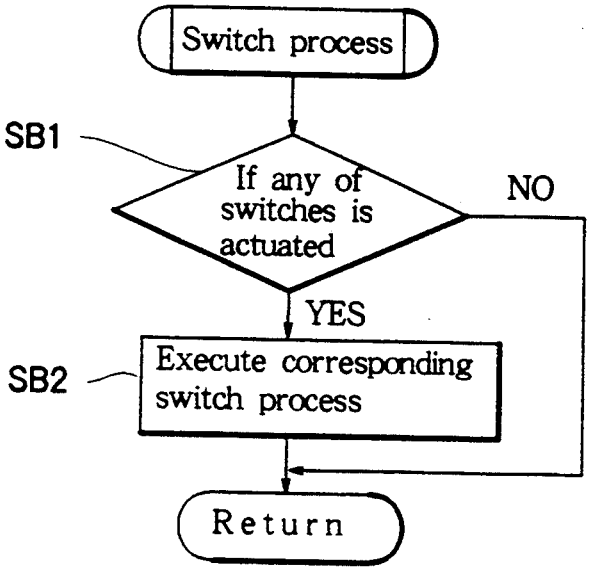

Referring to FIG. 3, the switch panel 7 contains an automatic accompaniment start/stop switch 7*a*, a timbre set switch 7*b*, a timbre select switch 7*c*, and several rhythm pattern select switches including Normal switch 7*d*, Bridge switch 7*e*, Introduction switch 7*f*, first Fill-in switch 7*g*, second Fill-in switch 7*h* and Ending switch 7*i*. In detail, the Introduction switch 7*f* is utilized to command the automatic accompaniment to start from the introduction pattern to thereafter switch to the normal pattern. The first Fill-in switch 7*g* is utilized to command a sequence of the automatic accompaniment to temporarily shift to the first fill-in pattern and thereafter to switch to the normal pattern. The second Fill-in switch 7*h* is utilized to command a sequence of the automatic accompaniment to shift temporarily to the second fill-in pattern and thereafter to switch to the bridge pattern. Functions of the remaining select switches will be described later. When, either the Normal switch 7*d* or Bridge switch 7*e* is operated, the automatic accompaniment switches to the normal pattern or bridge pattern, respectively, from a top of a next measure without regard to when the switch is actuated. In the case of the first and second fill-in patterns, when the Fill-in switch is actuated before $\frac{3}{4}$ of one measure length, the corresponding fill-in pattern is immediately sounded. On the other hand, when the Fill-in switch is actuated after $\frac{3}{4}$ of one measure length, the corresponding fill-in pattern is started and sounded from a top of the next measure. In the case of the ending pattern, when the Ending switch 7*i* is actuated in the first half period of one measure, the automatic accompaniment immediately shifts to the ending pattern. On the other hand, when the Ending switch 7*i* is actuated in the second half period of one measure, the automatic accompaniment shifts to the ending pattern from a top of the next measure. There are three different start modes of the automatic accompaniment. Namely, the accompaniment can be lead by the normal pattern, the bridge pattern or the introduction pattern. In the last mode, the normal pattern follows the introduction pattern.

Referring back again to FIG. 1, a switch event detection circuit 8 is provided for detecting actuation of the switches on the panel 7 to produce operation information corresponding to the actuated switch. The instrument further includes a display unit 9 having a liquid crystal panel, a sound source circuit 10 controlled by the CPU 1 to produce musical tone data, a D/A converter 11 for convening the musical tone data into an analog musical tone signal, and a sound system 12 composed of an amplifier and speaker etc., and receptive of the musical tone signal for generating a musical sound in combination of the manual performance and the automatic accompaniment.

Referring next to flowcharts of FIGS. 4–14, description will be given for operation of CPU 1 under command of the player in the above described construction. As the electronic musical instrument of FIG. 1 is powered, CPU 1 undertakes a main routine of FIG. 4 to proceed with step SA1 to effect initialization of various units of the instrument. This initialization includes setting of an initial timbre for the sound source circuit 10, clearing of registers in the RAM 4 and so on. Then, processing by CPU 1 advances to step SA2. In this step, switch processing is carried out effectively when any switch is actuated on the switch panel 7. A routine of this switch process is shown in the FIG. 5 flowchart. In step SB1 of this routine, a check is made to determine if any of the panel switches is turned on. In the case that the check result is held NO, nothing is done to thereby return to the FIG. 4 main routine to carry out step SA3. On the other hand, if the check result of step SB1 is held YES, i.e., any one of the switches has been operated on the panel 7, the process advances to step SB2. In this step, a particular switch process is executed correspondingly to the operated switch, thereafter returning to the FIG. 4 main routine to thereby proceed to step SA3. Other processings are carried out in this step SA3, thereafter returning to step SA2.

Figure 6:
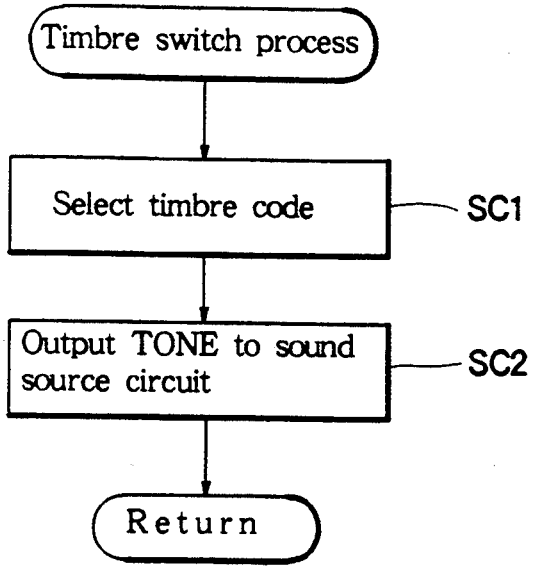

Next, the timbre switch process will be explained in conjunction with the FIG. 6 flowchart. When it is detected that any member of the timbre select switch 7*c* (FIG. 3) is depressed by the player in step SB1, the timbre switch process routine is called as shown in FIG. 6. CPU 1 operates firstly to proceed with step SC1 such that a timbre code register TONE is written with a selected timbre code assigned to the actuated member of the timbre select switch 7*c*, thereafter advancing to step SC2. In this step, the timbre code contained in the register TONE is fed to the sound source circuit 10. Hereinafter, a content of any register will be denoted by the same label as the register in the flowcharts. By this, the sound source circuit 10 sets a tone color corresponding to the fed timbre code. Then, CPU 1 returns to the main routine.

Figure 7:
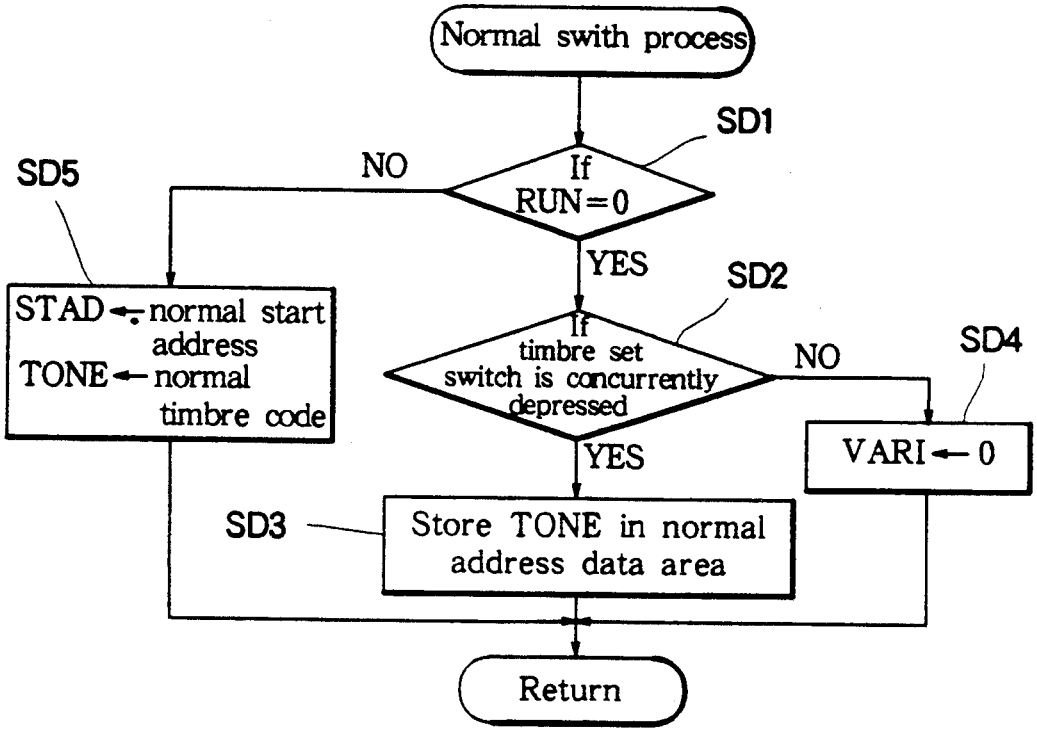

Next, the normal switch process will be explained in conjunction with FIG. 7. In processing of step SB1 shown in FIG. 5, when it is detected that the Normal switch 7*d* (FIG. 3) is depressed by the player, the normal switch process routine is called as shown in FIG. 7. CPU 1 firstly proceeds with step SD1 to check if a run flag RUN is reset to "0". The flag RUN is normally set to "1" when the automatic accompaniment is running. In the case that the check result is held YES, the processing advances to step SD2. In step SD2, check is made as to if the timbre set switch 7*b* (FIG. 3) is concurrently depressed with the Normal switch. When this check result is held YES, the processing advances to step SD3. In this step, the normal address data area provided in the FIG. 2 part (1) of the automatic accompaniment data area within RAM 4 is loaded with the timbre code which has been selected by the timbre switch process of FIG. 6 routine and which has been stored in the register TONE, thereafter returning to the main routine. On the other hand, in case that the check result of step SD2 is held NO, i.e., both the Normal switch 7*d* and the timbre set switch 7*b* are not concurrently depressed, the processing advances to step SD4. In this step, a register VARI is loaded with a value "0" which indicates that the automatic accompaniment should be lead by the normal pattern at the start thereof, thereafter returning to the main routine. Otherwise, the register VARI may be set with value "1", when the bridge pattern is selected as an initial or leading rhythm pattern of the automatic accompaniment, or the register VARI may be set with value "2" when the introduction pattern is selected as the initial rhythm pattern. The register VARI is reset to "0" by the initialization step SA1 shown in FIG. 4. Further, in case that the check result of step SD1 is held NO, i.e., the register RUN is set with "1" to show the running state of the automatic accompaniment, the processing advances to step SD5. In this step, the start address of the normal pattern is loaded into a register STAD which is provided to designate a start address of a next measure. At the same time, the register TONE is loaded with the timbre code which is stored in the normal address data area and which designates a tone color of the normal pattern. Thereafter, the processing returns to the main routine.

Figure 8:
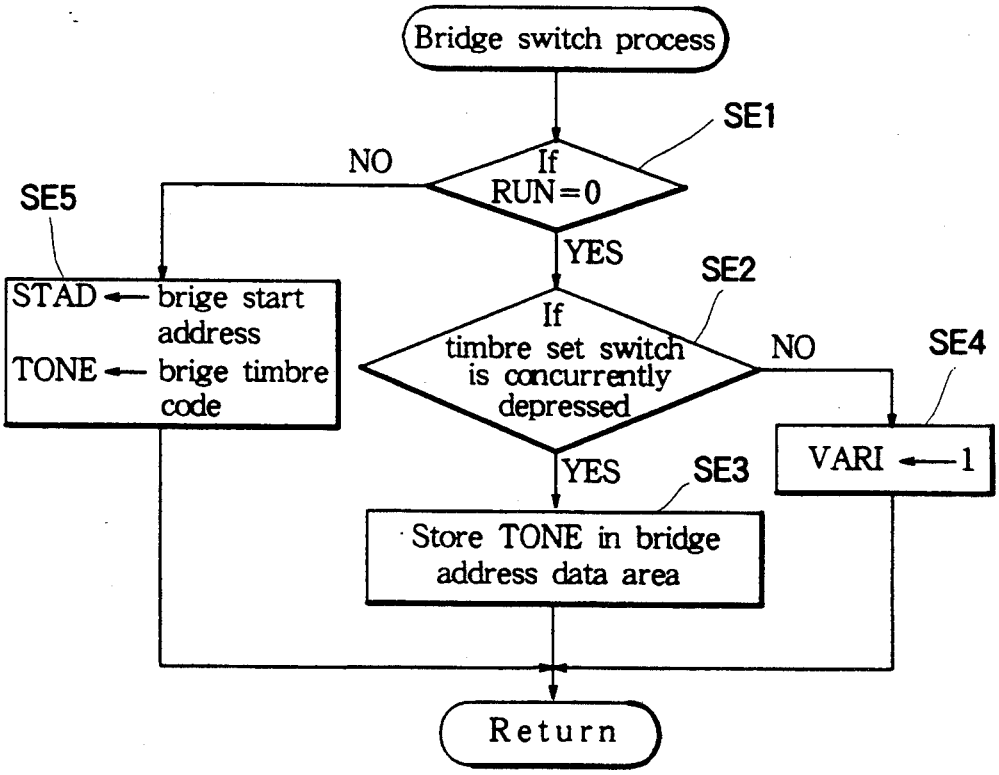

Next, the bridge switch process will be described in conjunction with the FIG. 8 flowchart. In step SB1 of FIG. 5, when it is detected that the player depresses the Bridge switch 7*e* (FIG. 3), the bridge switch process routine shown in FIG. 8 is called. CPU 1 firstly proceeds with step SE1 to check as to if the run flag RUN is reset to "0". In case that the check result is held YES, processing advances to step SE2. In step SE2, subsequent check is made as to if the timbre set switch 7*b* (FIG. 3) is concurrently depressed. In case that this check result is held YES, processing advances to step SE3. In step SE3, the bridge address data area contained in the FIG. 2 part (1) of the automatic accompaniment data area within RAM 4 is loaded with the timbre code which is selected by the FIG. 6 timbre switch process routine and which is stored in the register TONE, thereafter returning to the main routine. On the other hand, in case that the check result of step SE2 is held NO, i.e., when both of the Bridge switch 7*e* and the timbre set switch 7*b* are not concurrently depressed, processing advances to step SE4. In step SE4, the register VARI is loaded with value "1" indicative of the start by the bridge pattern, thereafter returning to the main routine. Further, in case that the check result of step SE1 is held NO, i.e., when the run flag RUN is set with "1" to show the running state of the automatic accompaniment, processing advances to step SE5. In step SE5, the register STAD is loaded with a start address of the bridge pattern, and the register TONE is loaded with the bridge timbre code which is stored in the bridge address data area and which designates the timbre of the bridge pattern.

Figure 9:
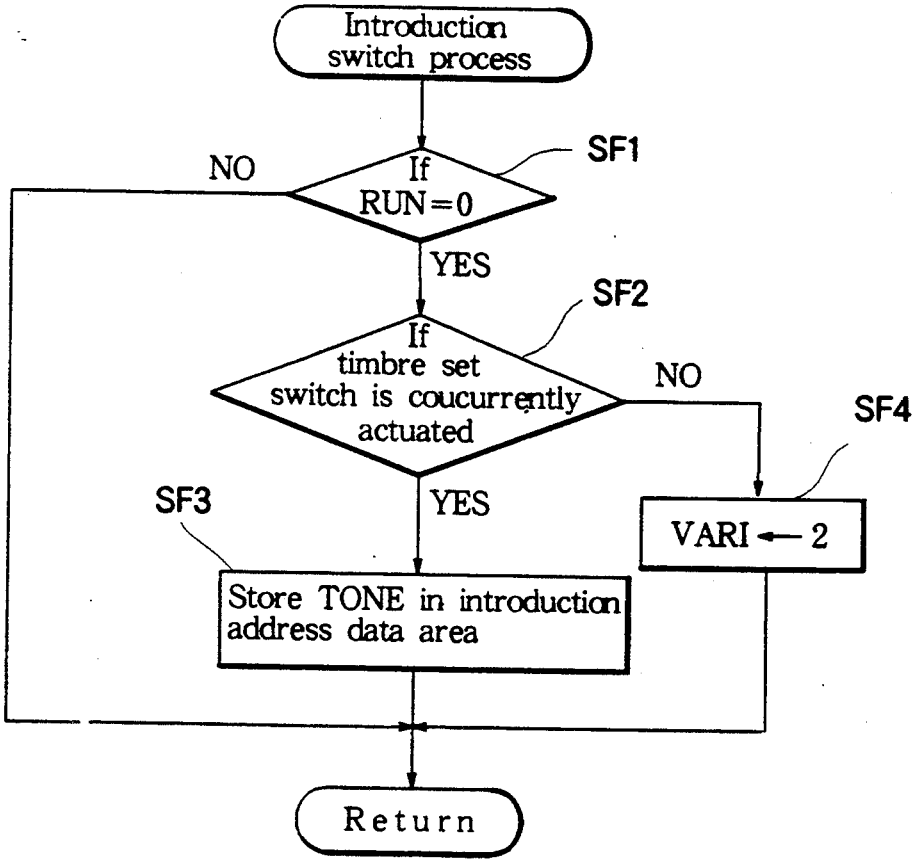

Next, the introduction switch process will be described in conjunction with the FIG. 9 flowchart. In the processing of step SB1 shown in FIG. 5, when it is detected that the player depresses the Introduction switch (FIG. 3), the introduction switch process routine is called as shown in FIG. 9. CPU 1 firstly proceeds with step SF1 to check as to whether the run flag RUN is reset to "0". In case that this check result is held NO, nothing is done to thereby return to the main routine. Namely, inadvertent actuation of the Introduction switch is not entered during the running of the automatic accompaniment. On the other hand, in case that the check result of step SF1 is held YES, i.e., when the run flag RUN is reset with "0", processing advances to step SF2. In step SF2, check is made as to if the timbre set switch 7*b* (FIG. 3) is concurrently depressed. In case that this check result shows YES, processing advances to step SF3. In step SF3, the introduction address data area provided in the FIG. 2 part (1) of the automatic accompaniment data area within RAM 4 is loaded with the introduction timbre code which is selected by the FIG. 6 timbre switch process routine and which is stored in the register TONE, thereafter returning to the main routine. On the other hand, in case that the check result of step SF2 is held NO, i.e., when both the Introduction switch 7*f* and the timbre set switch 7*b* are not concurrently depressed, subsequent step SF4 is undertaken. In step SF4, the register VARI is loaded with value "2" which denotes the start by the introduction pattern, thereafter returning to the main routine.

Figure 10:
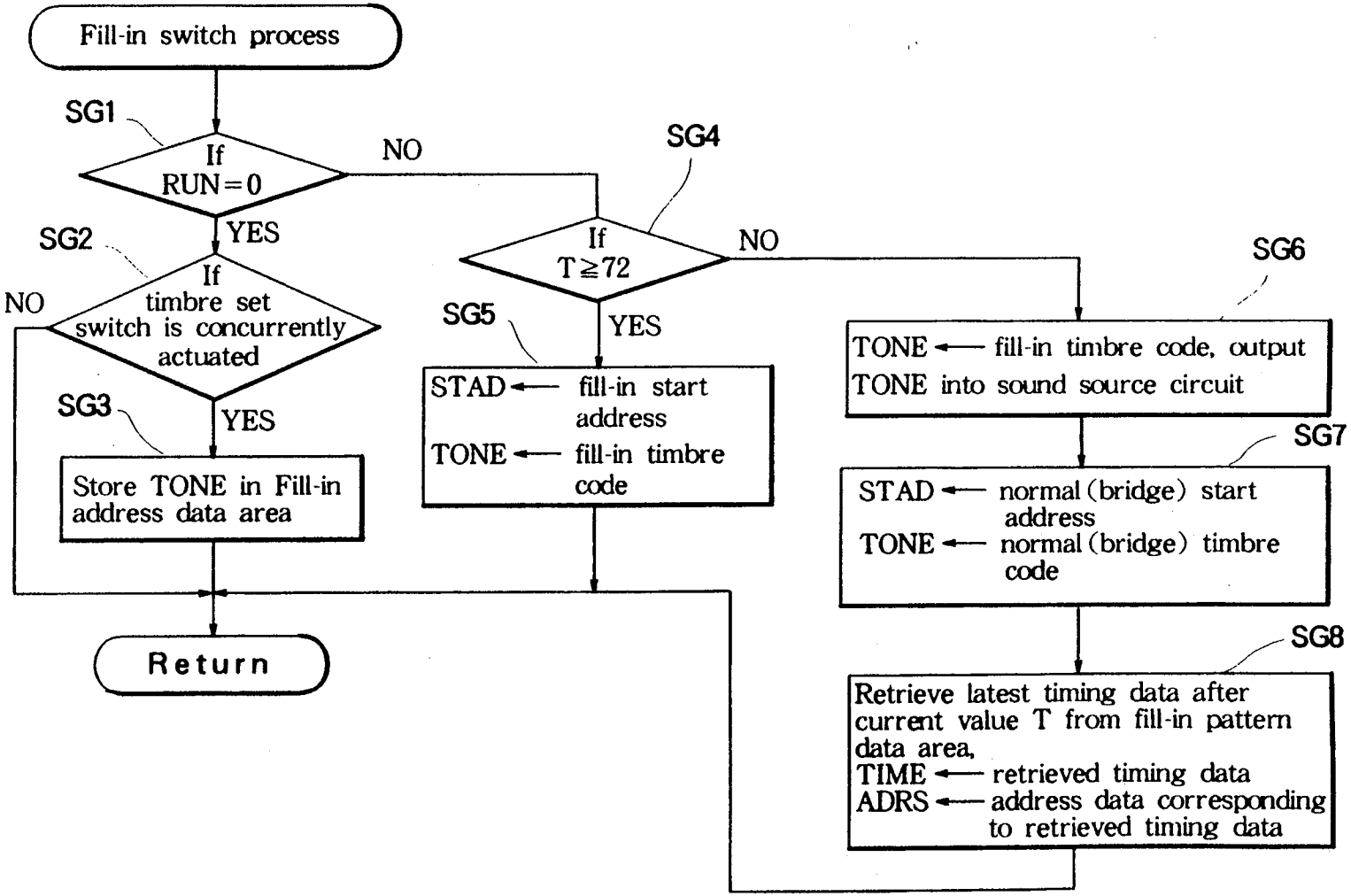

Next, the fill-in switch process will be explained with reference to the FIG. 10 flowchart. Substantially the same process can be applied to either of the first and second Fill-in switches 7*g*, 7*h*. Thus, in this description, the first and second Fill-in switches are explained commonly unless discrimination is otherwise specifically required. In step SB1 of the FIG. 5 flowchart, when it is detected that the player depresses the Fill-in switch 7*g* or 7*h* (FIG. 3), the Fill-in switch process routine is called as shown in FIG. 10. CPU 1 firstly proceeds with step SG1 to check as to whether the run flag RUN is reset to "0". In case that this check result is held YES, subsequent step SG2 is undertaken. In step SG2, check is made as to whether the timbre set switch 7*b* (FIG. 3) is concurrently depressed. In case that this check result is held NO, nothing is done to thereby return to the main routine. Namely, in view of the fact that the automatic accompaniment is not started normally from the fill-in pattern, inadvertent single actuation of the Fill-in switch 7*g* or 7*h* is not entered prior to the start of the automatic accompaniment. On the other hand, in case that the check result of step SG2 is held YES, i.e., when either of the first and second Fill-in switches 7*g* and 7*h* is actuated concurrently with depression of the timbre set switch 7*b*, step SG3 is undertaken. In step SG3, the corresponding fill-in address data area provided in the FIG. 2 part (1) of the automatic accompaniment data area within RAM 4 is loaded with the fill-in timbre code which is selected by the FIG. 6 timbre switch process routine and which is stored in the register TONE, thereafter returning to the main routine.

In turn, when the check result of step SG1 is held NO, i.e., when the run flag RUN is set to "1", step SG4 is undertaken. In step SG4, judgment is made as to if $T \geqq 72$ is satisfied where T denotes a content value of a time counter T which continuously counts 96 clocks each measure. As mentioned before in this embodiment, when the Fill-in switch 7*g* or 7*h* is actuated before $\frac{3}{4}$ of one measure length, the automatic accompaniment is instantly shifted to the corresponding fill-in pattern. On the other hand, if the Fill-in switch is actuated after $\frac{3}{4}$ of one measure length, the automatic accompaniment is switched in a delayed manner to the corresponding fill-in pattern from a top of the next measure. Thus, the check is made as to whether the value of the time counter T exceeds $\frac{3}{4}$ of the full count value 96, i.e., 72 clocks, so as to decide between the instant shift and the delayed shift.

In case that the check result of step SG4 is held YES, i.e., when the time counter value T equals or exceeds 72, step SG5 is undertaken. In step SG5, the start address of the fill-in pattern is loaded into the register STAD, and the fill-in timbre code stored in the fill-in address data area is loaded into the register TONE in order to switch to the fill-in pattern from a top of the next measure, thereafter returning to the main routine. On the other hand, if the check result of step SG4 is held NO, i.e., when the value T of the time counter is smaller than 72, step SG6 is undertaken. In step SG6, the fill-in timbre code stored in the fill-in address data area is loaded into the register TONE, and then the fill-in timbre code is fed from the register TONE to the sound source circuit 10, so that the automatic accompaniment immediately switches to the selected fill-in pattern and simultaneously the tone color is changed according to the fill-in timbre code in the sound source circuit 10. Then, CPU 1 proceeds to step SG7. In step SG7, the register STAD is stored with the start address of the normal pattern in the case that the first fill-in pattern has been selected or stored with the start address of the bridge pattern in the case that the second fill-in pattern has been selected, while the register TONE latches the corresponding timbre code registered in the normal address data area or the bridge address data area accordingly. Thereafter, step SG8 is undertaken. In step SG8, CPU 1 operates to search the fill-in pattern data area in the automatic accompaniment data area of the RAM 4 to retrieve the latest timing data just after the current value of the time counter T, and the retrieved timing data is latched into a time register TIME. The time register TIME operates during the course of the automatic accompaniment for comparing the timing data held therein and the value of the time counter T so as to read out, upon coincidence therebetween, an event data subsequent to that timing data. Further, CPU 1 loads an address data corresponding to the timing data stored in the time register TIME into an address pointer ADRS which is used for reading out the fill-in pattern data. By such operation, immediately when the value of the time counter T coincides with the searched timing data, the automatic accompaniment instantly switches to the fill-in pattern. Then, CPU 1 returns to the main routine.

Figure 11:
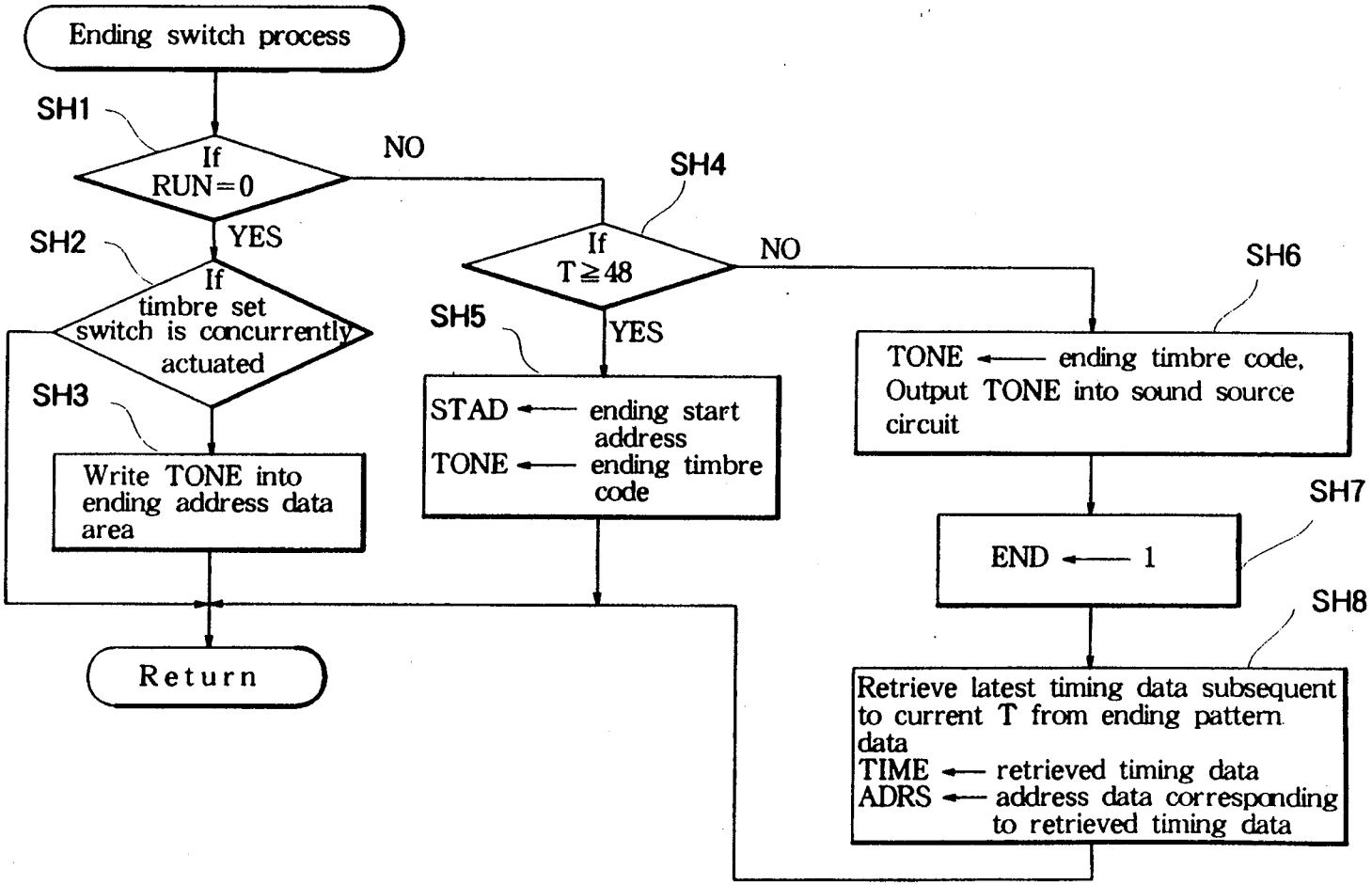

Next, ending switch process routine will be described in conjunction with the FIG. 11 flowchart. In the process of step SB1 shown in FIG. 5, when it is detected that the player depresses the Ending switch 7*i* (shown in FIG. 3), the ending switch process routine is called as shown in FIG. 11. CPU 1 firstly proceeds with step SH1 to check as to if the run flag RUN is set to "0". In the case that this check result is held YES, step SH2 is undertaken. In step SH2, subsequent check is made as to if the timbre set switch 7*b* (FIG. 3) is depressed concurrently. In the case that this check result shows NO, nothing is done to thereby return to the main routine. Namely, in a manner similar to the fill-in pattern, since the automatic accompaniment is never lead by the ending pattern, the single actuation of the Ending switch 7*i* is simply ignored. On the other hand, if the check result of step SH2 is held YES, namely when both of the Ending switch 7*i* and the timbre set switch 7*b* are depressed concurrently, step SH3 is undertaken. In step SH3, the FIG. 2 part (1) ending address data area in the automatic accompaniment data area of RAM 4 is written with the ending timbre code which is selected by the FIG. 6 timbre switch process routine and which is latched in the register TONE, thereafter returning to the main routine.

On the other hand, if the check result of step SH1 is held NO, namely when the register RUN is set to "1", step SH4 is undertaken. In step SH4, check is made as to if the value of the time counter T exceeds 48 clocks. As mentioned before in this embodiment, when the Ending switch 7*i* is actuated in a first half period of one measure, the ending pattern is effected instantly. Otherwise, when the Ending switch 7*i* is actuated in a second half period of one measure, the ending pattern is effected from a top of the next measure. In view of this, the judgment is made as to whether the value of the time counter T is not less than half of 96 clocks, i.e., 48 clocks so as to decide either instant shift to the ending pattern or delayed shift to the ending pattern from a top of the next measure. In the case that the check result of step SH4 is held YES, i.e., when the value of the time counter T is not less than 48 clocks, step SH5 is undertaken. In step SH5, the register STAD is loaded with the start address of the ending pattern and the register TONE is loaded with the ending timbre code which is stored in the ending address data area and which determines a tone color of the ending pattern, thereby shifting to the ending pattern from the top of the next measure. Thereafter, the processing returns to the main routine.

On the other hand, if the check result of step SH4 is held NO, i.e., when the value of the time counter T is smaller than 48 clocks, step SH6 is undertaken. In step SH6, in order to immediately shift to the ending pattern, the register TONE latches the ending timbre code registered in the ending address data area and associated to the ending pattern, and then the ending timbre code is fed from the register TONE to the sound source circuit 10. By this operation, the tone color is instantly changed in the sound source circuit 10. Thereafter, CPU 1 proceeds with step SH7. In step SH7, an end flag END is set to "1" indicating that currently the ending pattern is sounded. In subsequent step SH8, CPU 1 searches the ending pattern data area (FIG. 2, part (3)) in the automatic accompaniment data area of RAM 4 to retrieve the latest timing data subsequent to the current value of the time counter T, and the retrieved timing data is loaded into the time register TIME. Further, an address data corresponding to the retrieved timing data is set to the address pointer ADRS, thereafter returning to the main routine.

Figure 12:
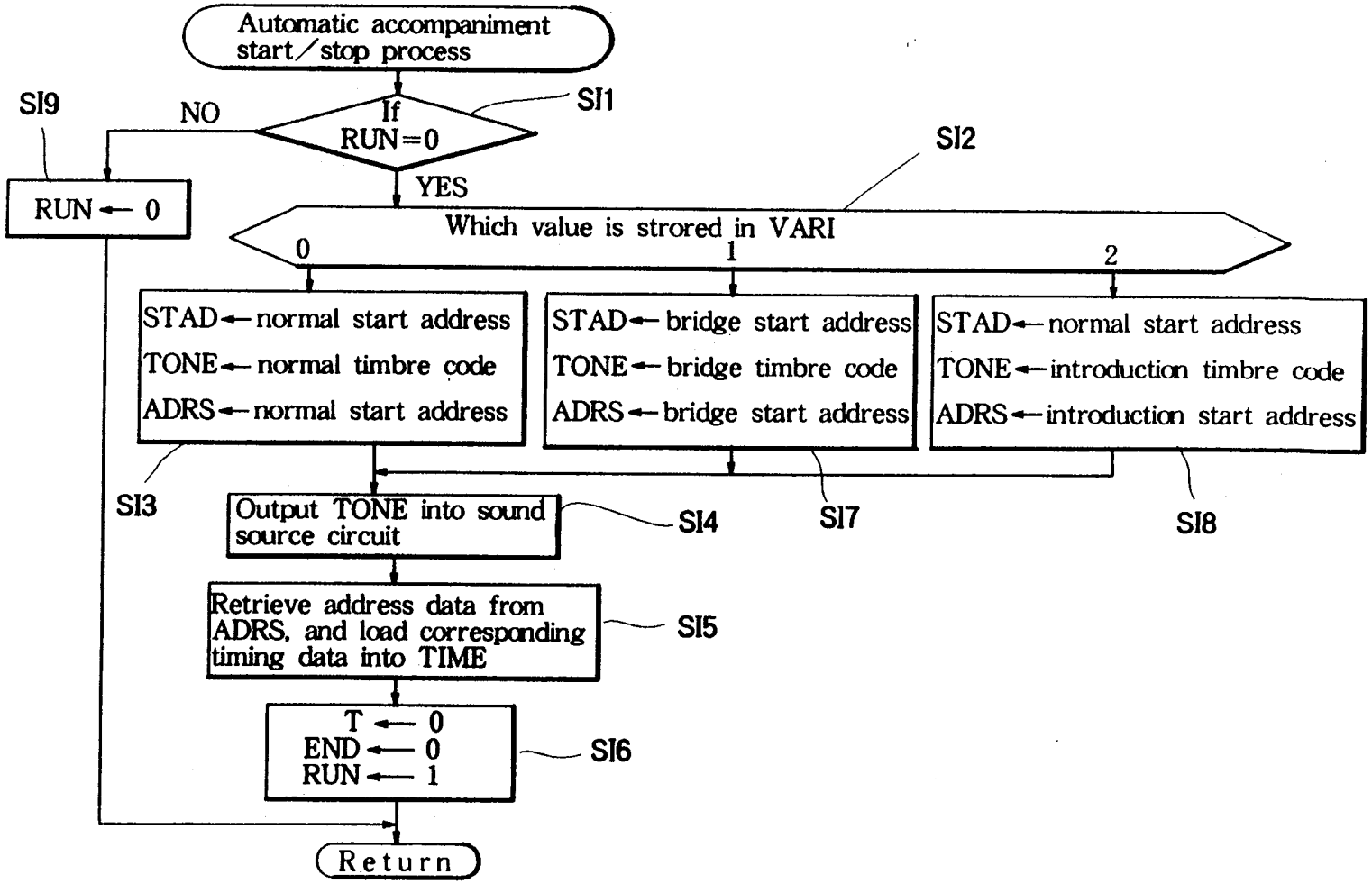

Next, automatic accompaniment start/stop switch process will be explained in conjunction with the FIG. 12 flowchart. In step SB1 of FIG. 5, when it is detected that the player depresses the automatic accompaniment start/stop switch *7a* (FIG. 3), the automatic accompaniment start/stop switch process routine is called as shown in FIG. 12. CPU 1 firstly proceeds with step SI1 to check as to if the run flag RUN has been reset with "0". In the case that the check result shows YES, CPU 1 proceeds with step SI2. In the this step, check is made as to which value of "0", "1" and "2" is stored in the register VARI which designates a start rhythm pattern of the automatic accompaniment pattern. In the case that the register VARI holds the value "0" which designates the normal pattern, step SI3 is undertaken. In this step, the register STAD latches the start address of the normal pattern and the register TONE latches the normal timbre code which is written together in the normal address data area and which specifies the tone color of the normal pattern. Further, the address pointer ADRS also latches the same start address of the normal pattern which is reserved in the normal address data area. Namely, in the case of the normal pattern start, a subsequent measure is also repeated by the same normal pattern. By this, the start setting is established such that the automatic accompaniment will be initiated from the first or start address of the normal pattern. Then, CPU 1 proceeds to step SI4. In step SI4, the normal timbre code stored in the register TONE is fed to the sound source circuit 10, thereby proceeding to step SIS. In step SI5, the address data stored in the address pointer ADRS is read out, and the corresponding timing data is loaded into the time register TIME, thereby advancing to step SI6. In step SI6, the time counter T is reset to "0", the end flag END is reset to "0", and the run flag RUN is set to "1", thereafter returning to the main routine.

On the other hand, when it is found that the register VARI holds the value "1" designating the bridge pattern in the process of step SI2, CPU 1 proceeds with step SI7. In step SI7, the register STAD latches the start address of the bridge pattern, and the register TONE latches the bridge timbre code which is held in the bridge address data area and which determines the tone color of the bridge pattern. Further, the address pointer ADRS latches the same start address of the bridge pattern written in the bridge address data area. Namely, in case of the start from the bridge pattern, a subsequent measure is repeated by the bridge pattern in a manner similar to the normal pattern. By this, the initial setting is established such that the automatic accompaniment will be started from the first or start address of the bridge pattern. Then, CPU 1 proceeds to step SI4.

Alternatively, when it is found in step SI2 that the register VARI holds the value "2" indicative of the introduction pattern, step SI8 is undertaken. In this step, the register STAD latches the start address of the normal pattern rather than that of the introduction pattern, since the automatic accompaniment is switched to the normal pattern after the automatic accompaniment is started by the introduction pattern. Further, CPU 1 operates to store the register TONE with the introduction timbre code written in the introduction address data area, and to store the address pointer ADRS with the start address of the introduction pattern written in the introduction address data area. By this, the initial setting is established such that the automatic accompaniment is initiated from the first address of the introduction pattern. Then, CPU 1 proceeds to step SI4.

Returning to step SI1, in the case that the check result of this step is held NO, namely when the run flag RUN has been set with "1" to indicate the running state of the automatic accompaniment, step SI9 is undertaken to reset the run flag RUN so as to stop the automatic accompaniment in response to the actuation of the start/stop switch *7a*, thereafter returning to the main routine.

Figure 13:
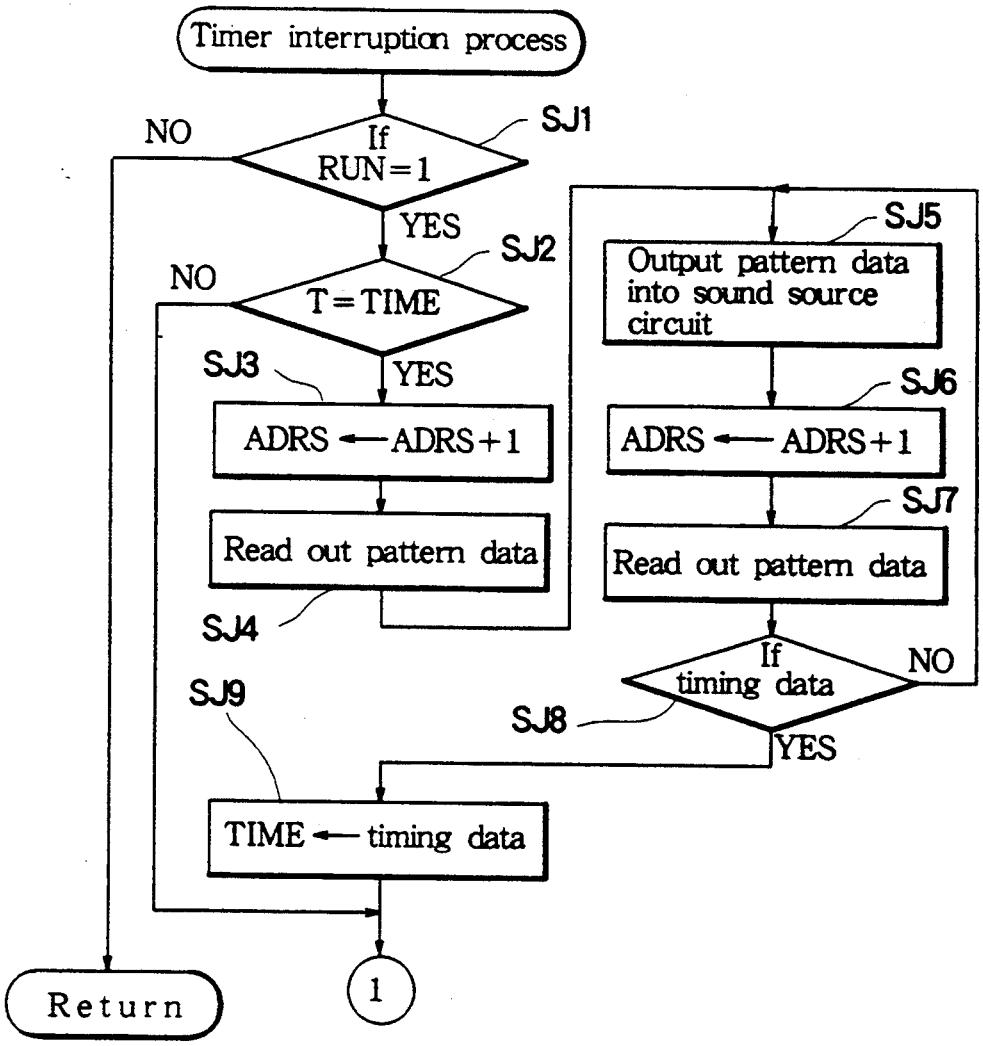
Figure 14:
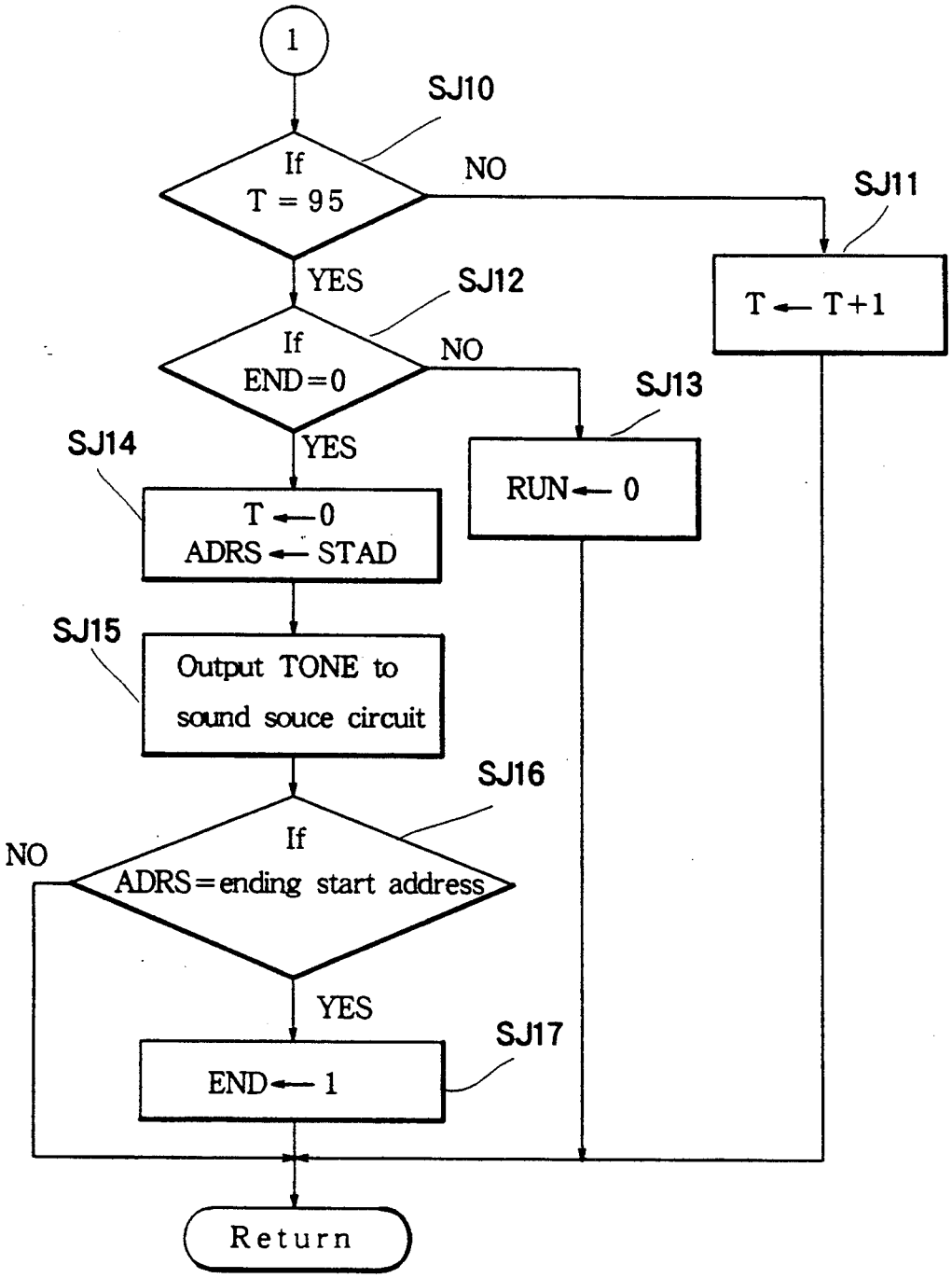

Next, description is given for the timer interruption process which is executed periodically, in conjunction with the flowchart of FIGS. 13 and 14. The timer interruption process routine is called every constant period. Firstly, CPU I proceeds with step SJ1 to check as to if the run flag RUN is set with "1". If this check result is held NO, nothing is done to thereby return to the main routine. On the other hand, if the check result of step SJ1 is held YES, i.e., when the run flag RUN is set with "1", step SJ2 is undertaken. In this step, check is made as to if the value of the time counter T coincides with the value of the time register TIME. In the initial state, the time counter T is loaded with the value "0" in the process of step SI6 shown in FIG. 12, the address pointer ADRS is loaded initially with the start address "0" by the process of step SI3, SI7 or SI8 shown in FIG. 12, and the time register TIME is loaded in step SI5 of FIG. 12 with the timing data which is written in a given pattern data area designated by that start address and which determines a timing at which a first note of the leading pattern is sounded. Normally, this timing data is set to "0" so that the check result of step SJ2 is found to be YES initially upon the coincidence between the timer counter T and the time register TIME, whereby CPU 1 proceeds to step SJ3. In this step, the address pointer ADRS is incremented by one step to proceed to the next step SJ4. In this step, a pattern data (initially a note number data) is read out from the pattern data area (FIG. 2, part (3)) of RAM 4 at a given location designated by the value of the address pointer ADRS, thereby advancing to step SJ5.

In step SJ5, the read pattern data is fed to the sound source circuit 10. By this processing, the sound source circuit 10 effects sounding of the accompaniment tone based on the fed pattern data. Then, CPU 1 proceeds to step SJ6. In step SJ6, the address pointer ADRS is again incremented by one step to thereby proceed to step SJ7.

In step SJ7, another pattern data (initially, a velocity data associated to the preceding note number data) is read out from the pattern data area (FIG. 2, part (3)) of RAM 4 at a certain location designated by the updated value of the address pointer ADRS, thereafter advancing to step SJ8. In this step, check is made as to if the pattern data read out in the process of step SJ7 is a timing data. In the case that this check result remains NO, the processing returns to step SJ5. On the other hand, if the check result of step SJ8 turns to YES, i.e., when a timing data is read out in the process of step SJ7, step SJ9 is undertaken. In this step, the timing data retrieved by step SJ7 is loaded into the time register TIME, thereafter advancing to step SJ10 shown in FIG. 14. Also, in the case that the check result of step SJ2 is found to be NO, i.e., when the value of the time counter T does not coincide with the content of the time register TIME, the processing advances to step SJ10.

In step SJ10, check is made as to if the value of the time counter T reaches "95". This check is carried out because the value of the time counter T is incremented by one step for each timer interruption routine in a following step and the value of the timer counter T is reset to "0" in another following step when the value of the timer counter T reaches "95". In the case that the check result of step SJ10 is held NO, step SJ11 is undertaken such that the value of the time counter T is incremented by one step, thereby returning to the main routine. On the other hand, if the check result of step SJ10 is found to be YES, i.e., when the value of the time counter T reaches "95", step SJ12 is undertaken. In this step, check is made as to whether the end flag END is reset to "0". In the case that this check result is found to be NO, step SJ13 is undertaken. In this step, since the ending pattern is currently sounded as the end flag END is set with "1" and the time counter T reaches the final value "95", the run flag RUN is reset to "0", thereby returning to the main routine in order to terminate the automatic accompaniment.

On the other hand, when the check result of step SJ12 remains NO, i.e., when the end flag END is kept in the reset state, step SJ14 is undertaken. In this step, the time counter T is reset to "0" and the address pointer ADRS is loaded with an address stored in the register STAD. By this operation, one measure length of the automatic accompaniment is completed, and the next pattern is determined for the subsequent measure of the automatic accompaniment. Then, CPU 1 proceeds to step SJ15. In step SJ15, the timbre code stored in the register TONE is outputted to the sound source circuit 10. Thereafter, step SJ16 is undertaken so that a check is made as to if the content of the address pointer ADRS is the start address of the ending pattern. In the case that this check result is held NO, nothing is done to thereby return to the main routine. On the other hand, if the check result of step SJ16 becomes YES, i.e., when the content of the address pointer is identical to the ending start address, step SJ17 is undertaken such that the end flag END is set to "1" to indicate the switching to the ending pattern, thereafter returning to the main routine.

Figure 15:
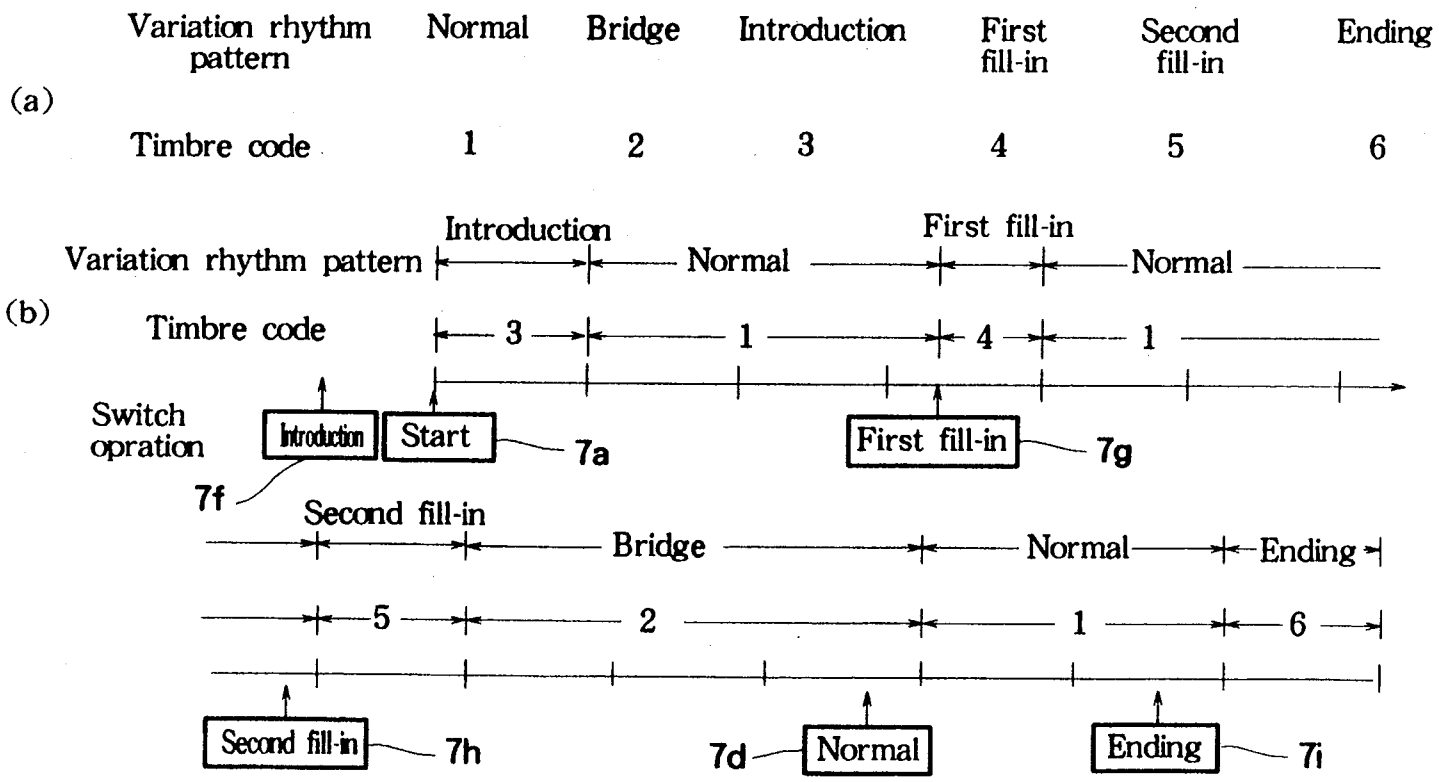
FIG. 15 is a schematic diagram showing a typical sequence of automatic accompaniment in the inventive electronic musical instrument.

Lastly, the description is given for an example of the switch operation practiced by the player during the manual performance, with reference to FIG. 15. Initially prior to start of the performance, for example as shown in FIG. 15(*a*), the player sets timbres individually for respective ones of the normal pattern, bridge pattern, introduction pattern, first fill-in pattern, second fill-in pattern and ending pattern by designating correspondingly different timbre codes "1", "2", "3", "4", "5" and "6", respectively.

Next, the player depresses the Introduction switch 7*f*, and subsequently depresses the Start/Stop switch 7*a* to initiate instantly the automatic accompaniment. Firstly, the temporary introduction pattern is sounded for one measure, and concurrently the tone color of the manual performance produced by the operation of the keyboard 5 is selected and set according to the timbre code "3". After the passage of the first one measure, the automatic accompaniment is switched to the non-temporary normal pattern. The tone color of the keyboard 5 is changed according to the timbre code "1" coincidentally with the switching from the introduction pattern to the normal pattern. The player manipulates the keyboard 5 to carry out the manual performance along with the automatic accompaniment.

While the player manipulates the keyboard 5 along with the automatic accompaniment, the player depresses the first Fill-in switch 7*g* at about a first quarter of the fourth measure. Consequently, the tone color of the keyboard 5 is switched instantly at that timing according to the timbre code 4, and concurrently the automatic accompaniment is switched to the temporary first fill-in pattern until the last of the fourth measure. Then, the accompaniment is returned to the non-temporary normal pattern from a top of the fifth measure. Accordingly, the player manipulates the keyboard 5 along with the normal pattern of the automatic accompaniment. At this moment, the tone color of the keyboard 5 is changed according to the timbre code "1".

Further, while manipulating the keyboard 5 along with the automatic accompaniment, the player depresses the second Fill-in switch 7*h* immediately before the eighth measure. Consequently, the tone color of the keyboard 5 is varied according to the timbre code "5" from the top of the eighth measure, and the temporary second fill-in pattern is sounded until the last of the eighth measure. Thereafter, the automatic accompaniment is switched to the subsequent non-temporary bridge pattern from the top of the ninth measure. Accordingly, the player manipulates the keyboard 5 along with the bridge pattern of the automatic accompaniment. At this moment, the tone color of the keyboard 5 is changed according to the timbre code 2.

Still further, while operating the keyboard 5, the player depresses the Normal switch 7*d* at the second half of the eleventh measure. Consequently, the tone color of the keyboard 5 is changed to the timbre code "1" from the top of the twelfth measure, and concurrently the normal pattern is sounded so that the player operates the keyboard 5 along with the automatic accompaniment of the normal pattern. Lastly, while playing on the keyboard 5 along with the automatic accompaniment, the player depresses the Ending switch 7*i* at the second half of the thirteenth measure. Consequently, the tone color is varied according to the timbre code "6" from the top of the fourteenth measure, and concurrently the automatic accompaniment is switched to the ending pattern until the end of the fourteenth measure to thereby terminate the sounding. Accordingly, the player manipulates the keyboard 5 along with the automatic accompaniment of the ending pattern to finish the manual performance. At this moment, the tone color is set to the timbre code "6". Though different timbres are assigned to the respective variation rhythm patterns in the above described embodiment, it may be expedient to set the same timbre commonly to plural variation rhythm patterns.

As described above, according to the invention, tone colors of the manual performance are set individually for respective rhythm patterns. In response to the selection of a particular rhythm pattern, the timbre of the manual performance tone is changed simultaneously, thereby advantageously simplifying the manual operation of the instrument and facilitating concurrent switching of the rhythm pattern and the timbre.

What is claimed is:

1. An electronic musical instrument operable for manual performance along with automatic accompaniment, comprising: memory means for memorizing a plurality of rhythm patterns, including at least one pattern of a group of patterns consisting of an introduction pattern, a normal pattern, a fill-in pattern and an ending pattern, the plurality of rhythm patterns being arranged serially to form the automatic accompaniment and for memorizing timbre codes which are set corresponding to respective ones of the rhythm patterns, and which are effective to specify tone color of the manual performance; selecting means manually operable during the course of the manual performance for selecting a desired one of the rhythm patterns; and control means responsive to the selecting means for reading out the selected rhythm pattern from the memory means to switch the automatic accompaniment to the selected rhythm pattern and for changing the tone color of the manual performance concurrently with switching of the automatic accompaniment according to a certain timbre code which is set correspondingly to the selected rhythm pattern.

2. An electronic musical instrument according to claim 1; wherein the control means includes detecting means for detecting a moment when the selecting means is manually operated within one measure of the automatic accompaniment, and deciding means operative according to the detected moment for deciding whether the automatic accompaniment should be switched instantly in said one measure or should be switched from a top of a next measure subsequent to said one measure.

3. An electronic musical instrument according to claim 1; wherein the memory means stores a temporary rhythm pattern and a non-temporary rhythm pattern, and the control means includes means operative after the temporary rhythm pattern is selected and finished for switching back automatically from the temporary rhythm pattern to the non-temporary rhythm pattern.

4. An electronic musical instrument according to claim 1; including setting means cooperative with the selecting means and manually operable prior to start of the automatic accompaniment for setting a desired timbre code for each rhythm pattern.

5. An electronic musical instrument operable for manual performance along with automatic accompaniment, comprising: memory means for memorizing a plurality of accompaniment patterns, including at least one pattern of a group of patterns consisting of an introduction accompaniment pattern, a normal accompaniment pattern, a fill-in accompaniment pattern and an ending accompaniment pattern, which can be arranged serially to form the automatic accompaniment, and for memorizing a plurality of timbre information which are stored correspondingly to respective accompaniment patterns and which can specify a tone color of the manual performance; selecting means for selecting a desired one of the accompaniment patterns; reading means for reading out the selected accompaniment pattern and the corresponding timbre information from the memory means; a manual implement operable to play the manual performance; and generating means for generating a tone of the automatic accompaniment according to the read accompaniment pattern and for generating, in response to the operation of the manual implement, another tone of the manual performance having a tone color specified by the read timbre information.

6. An electronic musical instrument according to claim 5; further including setting means for setting timbre information to be stored in the memory means in a desired manner.

7. An electronic musical instrument according to claim 6; wherein the setting means comprises designating means for manually designating a desired one of different timbres, and writing means for writing timbre information representative of the designated timbre into the memory means.

8. An electronic musical instrument comprising: memory means for memorizing a plurality of performance patterns, including an introduction performance pattern, a normal performance pattern, a fill-in performance pattern and an ending performance pattern; reading means for reading out one performance patterns; switching means for switching from said one performance pattern another performance pattern during the course of reading operation of the memory means; a manual implement operable to input a manual performance manner; generating means for generating a musical tone according to the read performance pattern and the inputted manual performance; and control means for changing a tone color of the musical tone in response to the switching from said one performance pattern to said another performance pattern.

9. An electronic musical instrument according to claim 8; wherein the switching means includes means manually operable by a player at a certain timing within a given measure to command the switching from said one performance pattern to said another performance pattern, and means for effecting the switching from the said one performance pattern to said another performance pattern from a top of a next measure subsequent to said given measure.

10. An electronic musical instrument operable for manual performance along with automatic accompaniment, comprising: memory means for memorizing a plurality of rhythm patterns which are arranged serially to form the automatic accompaniment and for memorizing timbre codes which are set corresponding to respective ones of the rhythm patterns, and which are effective to specify tone color of the manual performance; selecting means manually operable during the course of the manual performance for selecting a desired rhythm pattern; control means responsive to the selecting means for reading out the selected rhythm pattern from the memory means to switch the automatic accompaniment to the selected rhythm pattern and for changing the tone color of the manual performance concurrently with switching of the automatic accompaniment according to a certain timbre code which is set correspondingly to the selected rhythm pattern; and setting means cooperative with the selecting means and manually operable prior to start of the automatic accompaniment for setting a desired timbre code corresponding to each rhythm pattern.

11. An electronic musical instrument according to claim 10; wherein the control means includes detecting means for detecting a moment when the selecting means is manually operated within one measure of the automatic accompaniment, and deciding means operative according to the detected moment for deciding whether the automatic accompaniment should be switched instantly in said one measure or should be switched from a top of a next measure subsequent to said one measure.

12. An electronic musical instrument according to claim 10; wherein the memory means stores a temporary rhythm pattern and a non-temporary rhythm pattern, and the control means includes means operative after the temporary rhythm pattern is selected and finished for switching back automatically from the temporary rhythm pattern to the non-temporary rhythm pattern.

13. An electronic musical instrument operable for manual performance along with automatic accompaniment, comprising: memory means for memorizing a plurality of accompaniment patterns of the automatic accompaniment and a plurality of timbre information which are stored correspondingly to respective accompaniment patterns and which can specify a tone color of the manual performance; selecting means for selecting a desired one of the accompaniment patterns; reading means for reading out the selected accompaniment pattern and the corresponding timbre information from the memory means; a manual implement operable to play the manual performance; generating means for generating a tone of the automatic accompaniment according to the read accompaniment pattern and for generating, in response to the operation of the manual implement, another tone of the manual performance having a tone color specified by the read timbre information; and setting means for setting timbre information to be stored in the memory means in a desired manner, the setting means comprising designating means for manually designating a desired one of different timbres, and writing means for writing timbre information representative of the designated timbre into the memory means.

14. An electronic musical instrument according to claim 13; wherein the memory means includes means for storing an introduction accompaniment pattern, a normal accompaniment pattern, a fill-in accompaniment pattern and an ending accompaniment pattern, and the selecting means includes means for selecting these introduction, normal, fill-in and ending accompaniment patterns.

15. An electronic musical instrument comprising: memory means for memorizing first and second performance patterns; reading means for reading out either first and second performance patterns; switching means for switching from the first performance pattern to the second performance pattern during the course of reading operation of the memory means; a manual implement operable to input a manual performance; generating means for generating a musical tone according to the read performance pattern and the inputted manual performance; control means for changing a tone color of the musical tone in response to the switching from the first performance pattern to the second performance pattern; and setting means manually operable prior to start of the manual performance for setting desired tone colors corresponding to the first and second performance patterns.

16. An electronic musical instrument according to claim 15; wherein the switching means includes manually operable by a player at a certain timing within a given measure to command the switching from the first performance pattern to the second performance pattern, and means for effecting the switching from the first performance pattern to the second performance pattern from a top of a next measure subsequent to said given measure.

* * * * *